US012746452B2

(12) United States Patent
Yeh

(10) Patent No.: US 12,746,452 B2
(45) Date of Patent: Sep. 29, 2026

(54) EFFICIENT AND STABLE SKATE BOARD

(71) Applicant: Jih-Wei Yeh, New Taipei City (TW)

(72) Inventor: Jih-Wei Yeh, New Taipei City (TW)

( * ) Notice: Subject to any disclaimer, the term of this patent is extended or adjusted under 35 U.S.C. 154(b) by 169 days.

(21) Appl. No.: 18/965,141

(22) Filed: Dec. 2, 2024

(65) Prior Publication Data

US 2025/0345695 A1 Nov. 13, 2025

(30) Foreign Application Priority Data

May 9, 2024 (TW) ..... 113117200

(51) Int. Cl.
*A63C 17/01* (2006.01)

(52) U.S. Cl.
CPC ..... *A63C 17/012* (2013.01)

(58) Field of Classification Search
CPC ..... A63C 17/01; A63C 17/012; A63C 17/12
USPC ..... 280/87.042, 260
See application file for complete search history.

(56) References Cited

U.S. PATENT DOCUMENTS 5,165,710 A * 11/1992 Runyon ..... A63C 17/01 280/217
6,659,480 B1 * 12/2003 Newman ..... A63C 17/01 188/74
6,726,523 B2 * 4/2004 Baker ..... A63H 11/10 180/181
8,608,185 B2 * 12/2013 Bermal ..... A63C 17/0093 280/87.042
11,439,889 B1 * 9/2022 Pasic ..... A63C 17/0046
12,053,689 B1 * 8/2024 Oliphant ..... A63C 17/0046
12,109,481 B2 * 10/2024 Stagner ..... A63C 17/012
2004/0100053 A1 * 5/2004 Chen ..... B62K 3/002 280/87.041
2011/0089659 A1 * 4/2011 Hunt ..... A63C 17/018 280/124.121
2025/0276235 A1 * 9/2025 Xu ..... A63C 17/0046
2025/0345695 A1 * 11/2025 Yeh ..... A63C 17/012

FOREIGN PATENT DOCUMENTS

CN 109999475 A * 7/2019 ..... A63C 17/01
CN 118320402 A * 7/2024 ..... A63C 17/01
CN 120643894 A * 9/2025 ..... H02P 6/04
DE 102016223601 A1 * 5/2018 ..... A63C 17/015
WO WO-0108759 A1 * 2/2001 ..... A63C 17/1409
WO WO-2013103373 A1 * 7/2013 ..... A63C 17/012

* cited by examiner

*Primary Examiner* — James A Shriver, II
(74) *Attorney, Agent, or Firm* — Wang Law Firm, Inc.

(57) ABSTRACT

A rolling unit includes a truck, a box, a transmission, an axle, two wheels, a hollow shaft, two driven bevel gears, two unidirectional bearings, an input gear, an output gear and an acceleration mechanism. The truck is connected to a deck of a skateboard. The box is pivotally connected to the truck. The transmission includes a driving bevel gear connected to the pinion. The pinion is located out of the box and engaged with a rack of the truck. The driving bevel gear is located in the box. The wheels are connected to the axle. The hollow shaft wraps the axle. The driven bevel gears are engaged with the driving bevel gear. The unidirectional bearings support the driven bevel gears on the hollow shaft. The input gear is connected to the hollow shaft. The output gear is connected to the axle. The acceleration mechanism is arranged between the input and output gears.

3 Claims, 10 Drawing Sheets

EFFICIENT AND STABLE SKATE BOARD

BACKGROUND OF INVENTION

1. Field of Invention

The present invention relates to a skateboard and, more particularly, to an efficient and stable skateboard.

2. Related Prior Art

A user propels a skateboard in one of multiple ways. Firstly, the user stands on a skateboard with one leg and pushes a floor or the ground with the other leg. Secondly, the user stands on the skateboard with two legs and skids down a slope. Thirdly, the user stands on the skateboard with two legs, leans, rises and twists his or her body and legs.

The user can move the skateboard fast in a combination of the second manner with the third manner. It is difficult however to move the skateboard on a horizontal floor or up on a slope in the third manner. It requires the user to twist his or her body significantly to move the skateboard. However, it is difficult for a beginner to twist his or her body significantly and keeps balance at the same time.

The present invention is therefore intended to obviate or at least alleviate the problems encountered in the prior art.

SUMMARY OF INVENTION

It is the primary objective of the present invention to provide an efficient and stable skateboard.

To achieve the foregoing objective, the skateboard includes a deck and a rolling unit. The rolling unit includes a truck, a box, a transmission, an axle, two wheels, a hollow shaft, two driven bevel gears, two unidirectional bearings, an input gear, an output gear and an acceleration mechanism. The truck includes a plate connected to the deck and a tab extending from the plate and includes a rack. The box is pivotally connected to the plate. The transmission includes a pinion and a driving bevel gear connected to the pinion so that they are rotatable with each other. The pinion is located out of the box and engaged with the rack. The driving bevel gear is located in the box. The axle includes a middle section extending in the box and two ends extending from the box. The wheels are respectively connected to the ends of the axle. The hollow shaft wraps the axle. The driven bevel gears are engaged with the driving bevel gear. The unidirectional bearings respectively support the driven bevel gears on the hollow shaft. The input gear is connected to the hollow shaft so that they are rotatable with each other. The output gear is connected to the axle so that they are rotatable with each other. The acceleration mechanism is arranged between the input and output gears. Advantageously, the acceleration mechanism turns mild movement of the user into considerable movement of the skateboard. Hence, the user easily propels the skateboard.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
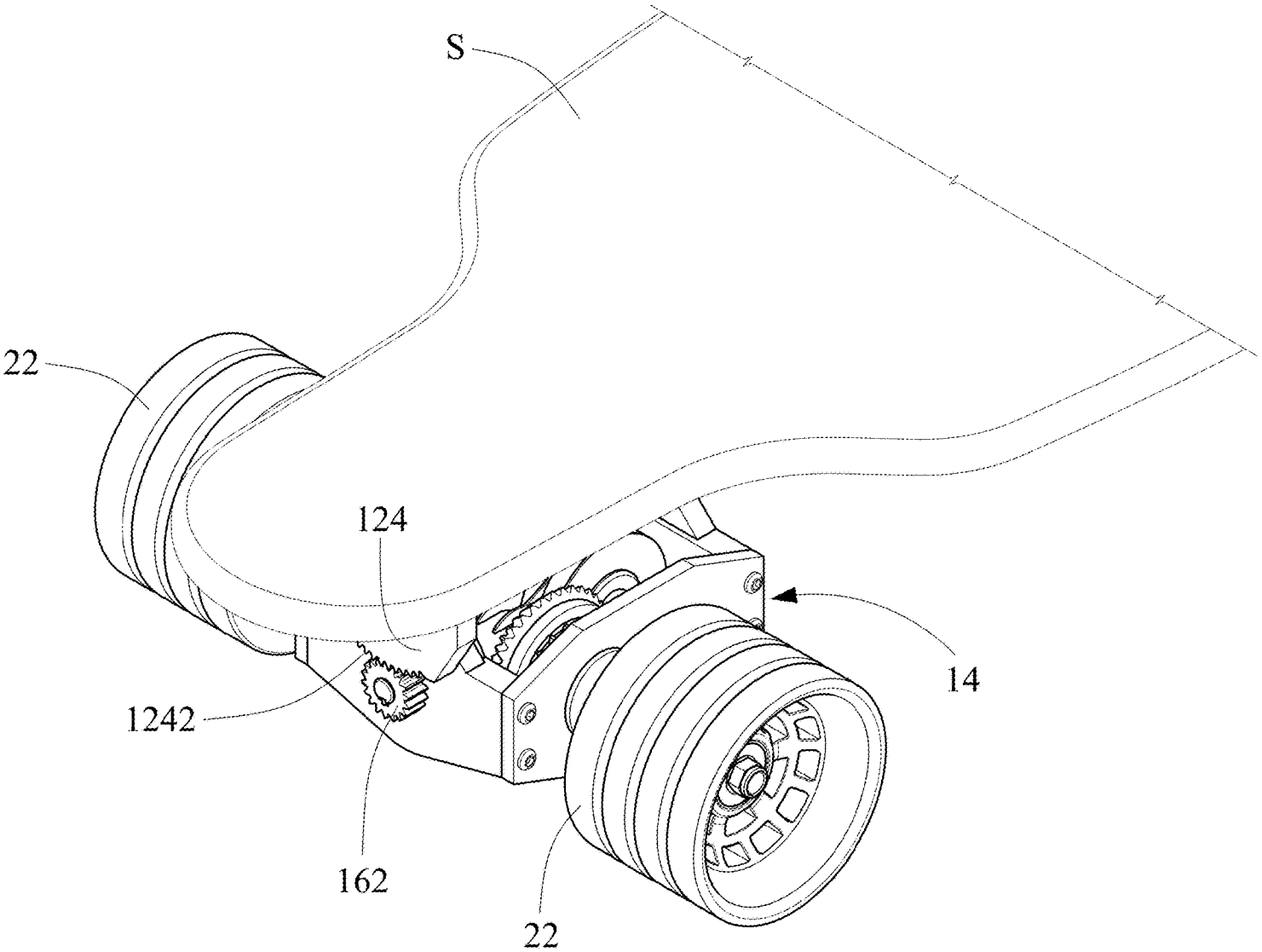
FIG. 1 is a partial and perspective view of a skateboard according to the preferred embodiment of the present invention.
Figure 2:
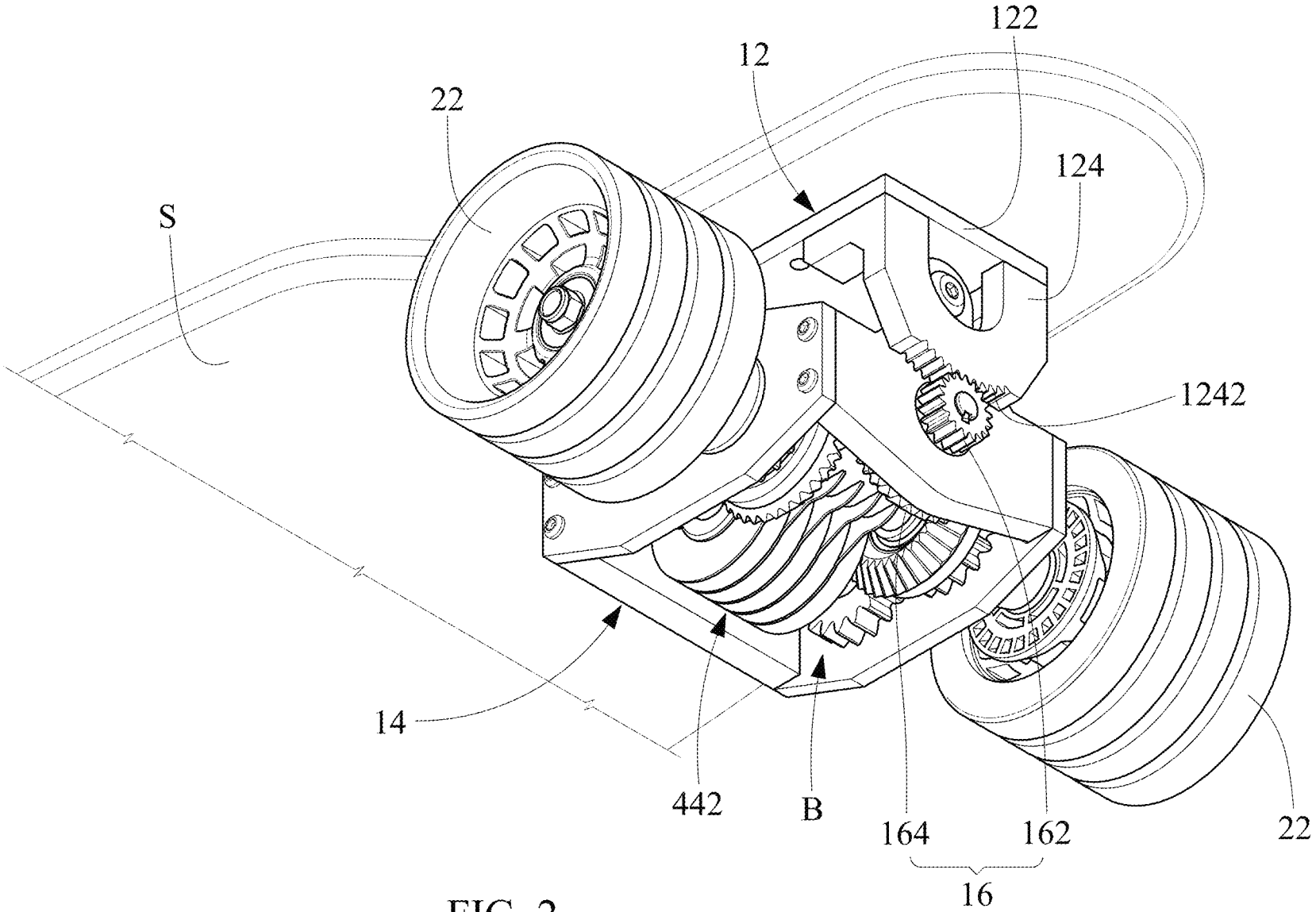
FIG. 2 is another partial and perspective view of the skateboard shown in FIG. 1.
Figure 3:
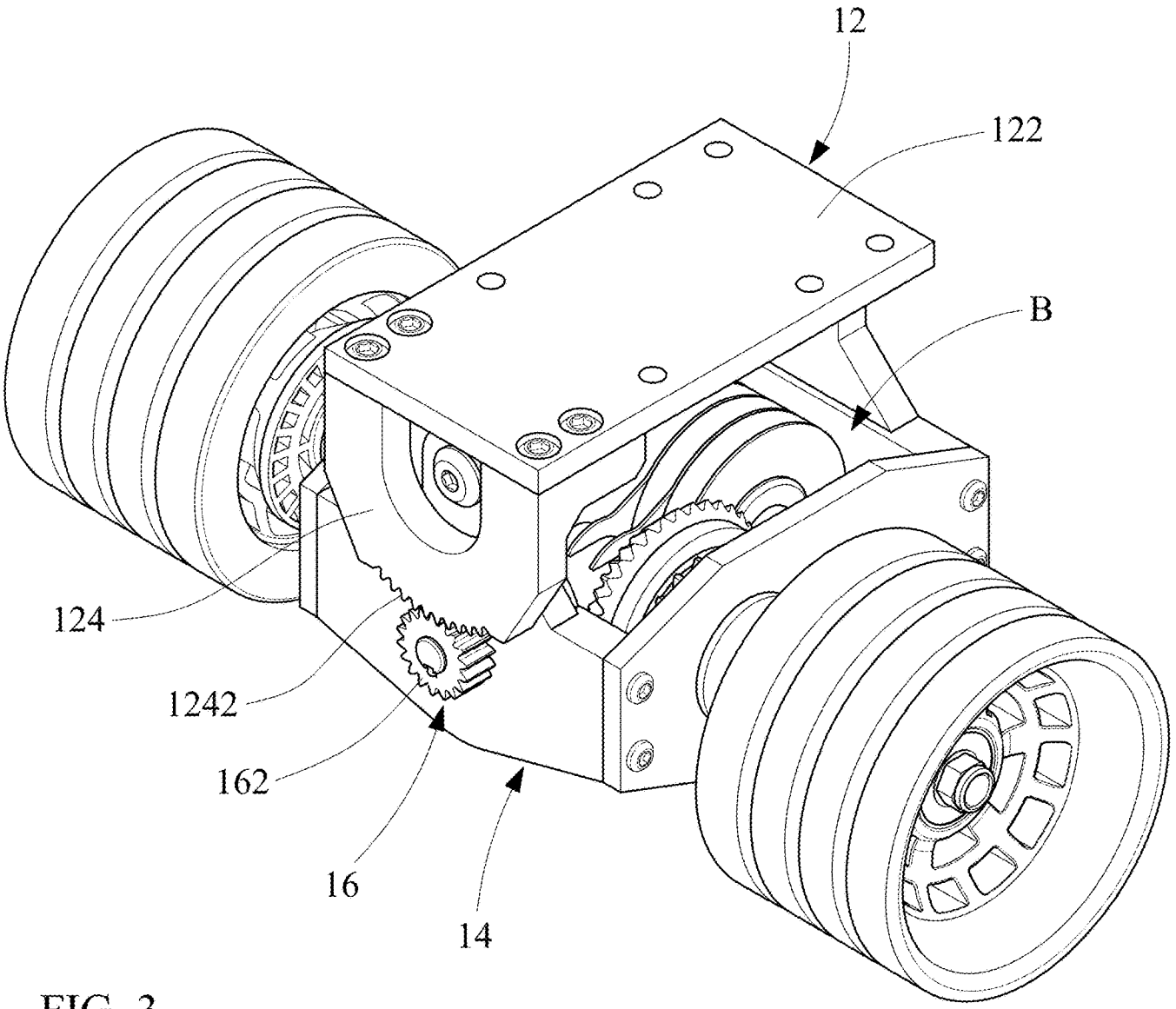
FIG. 3 is perspective view of a rolling unit of the skateboard shown in FIG. 1.
Figure 4:
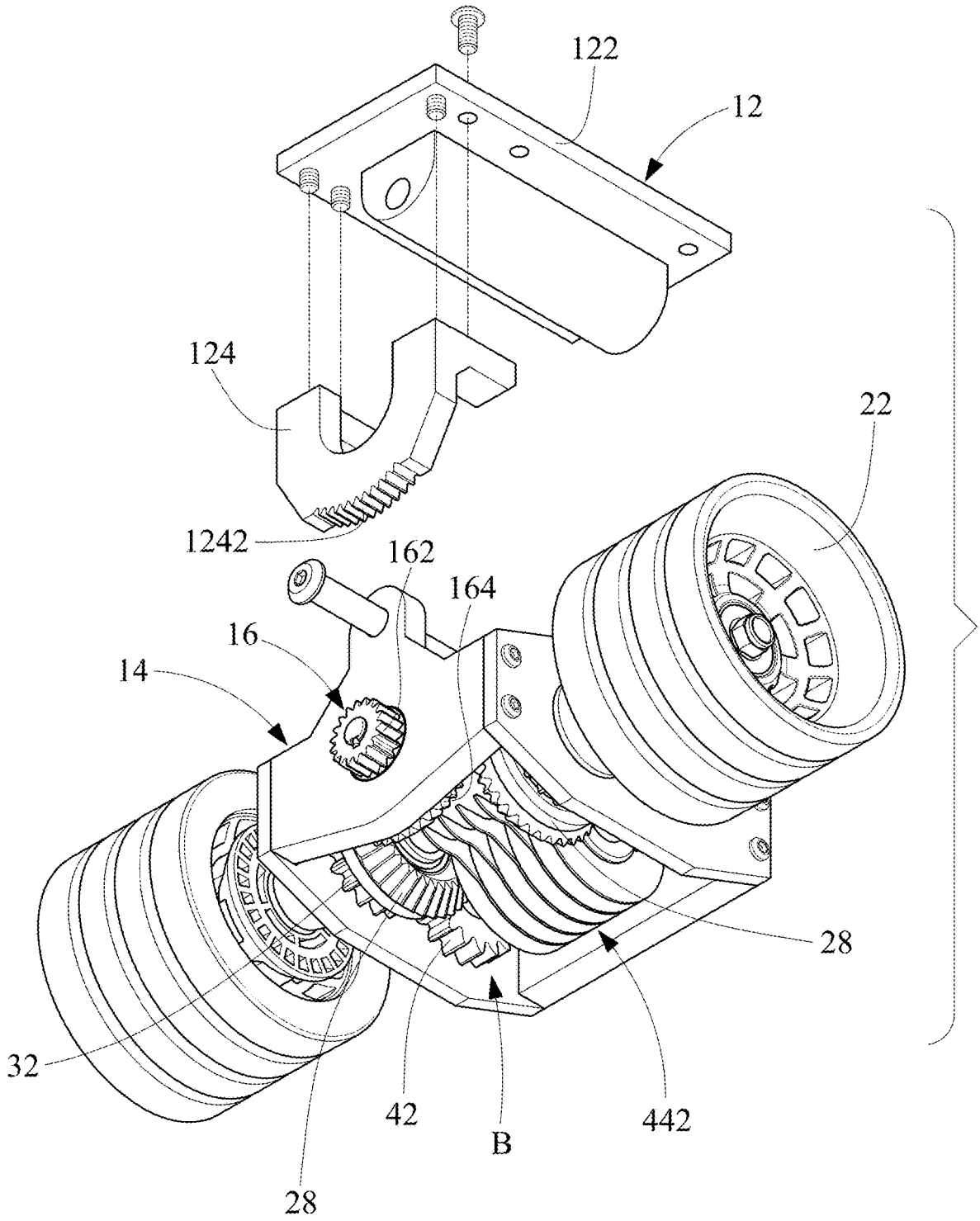
FIG. 4 is an exploded view of the rolling unit shown in FIG. 3.
Figure 5:
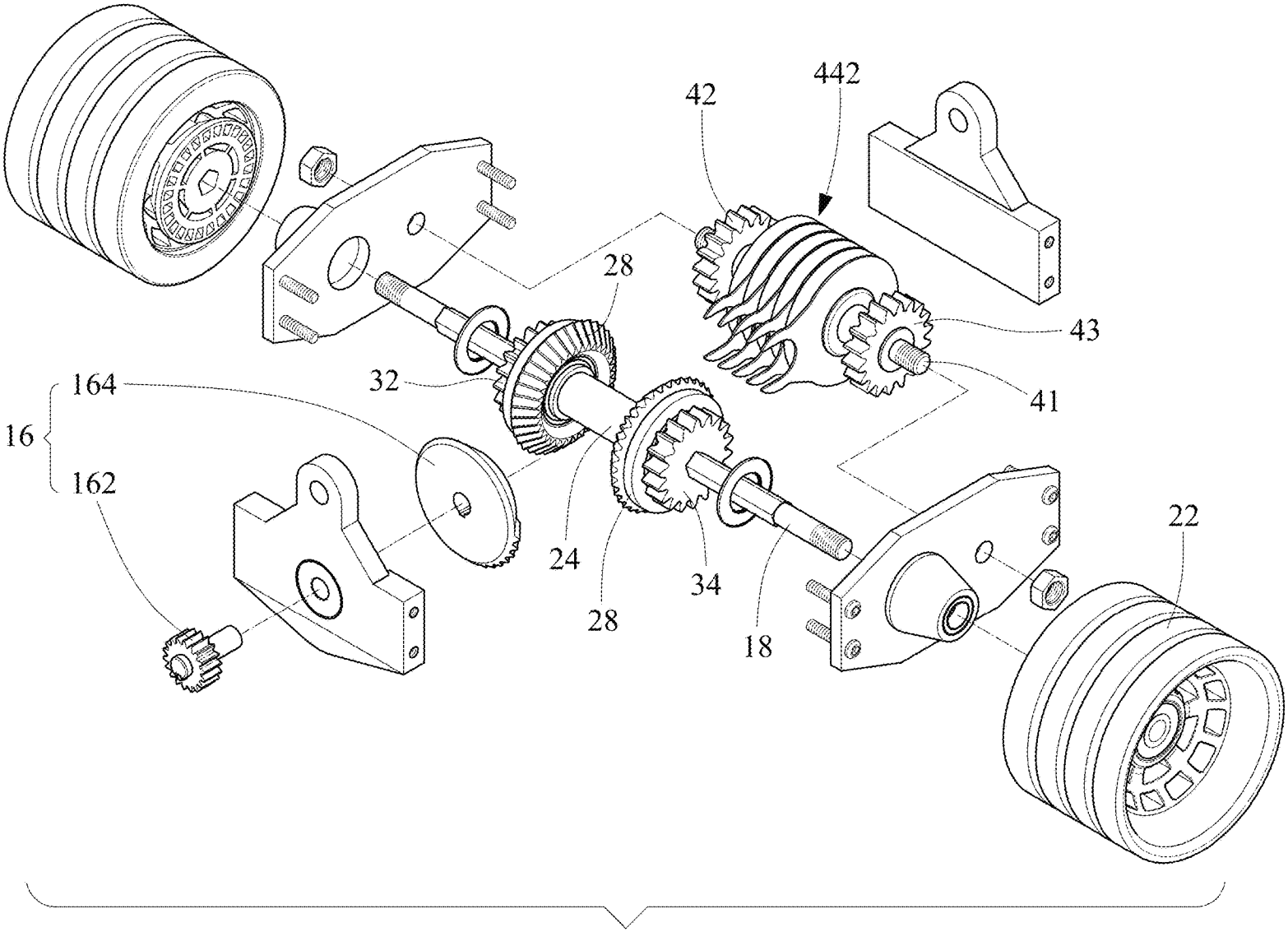
FIG. 5 is another exploded view of the rolling unit shown in FIG. 3.
Figure 6:
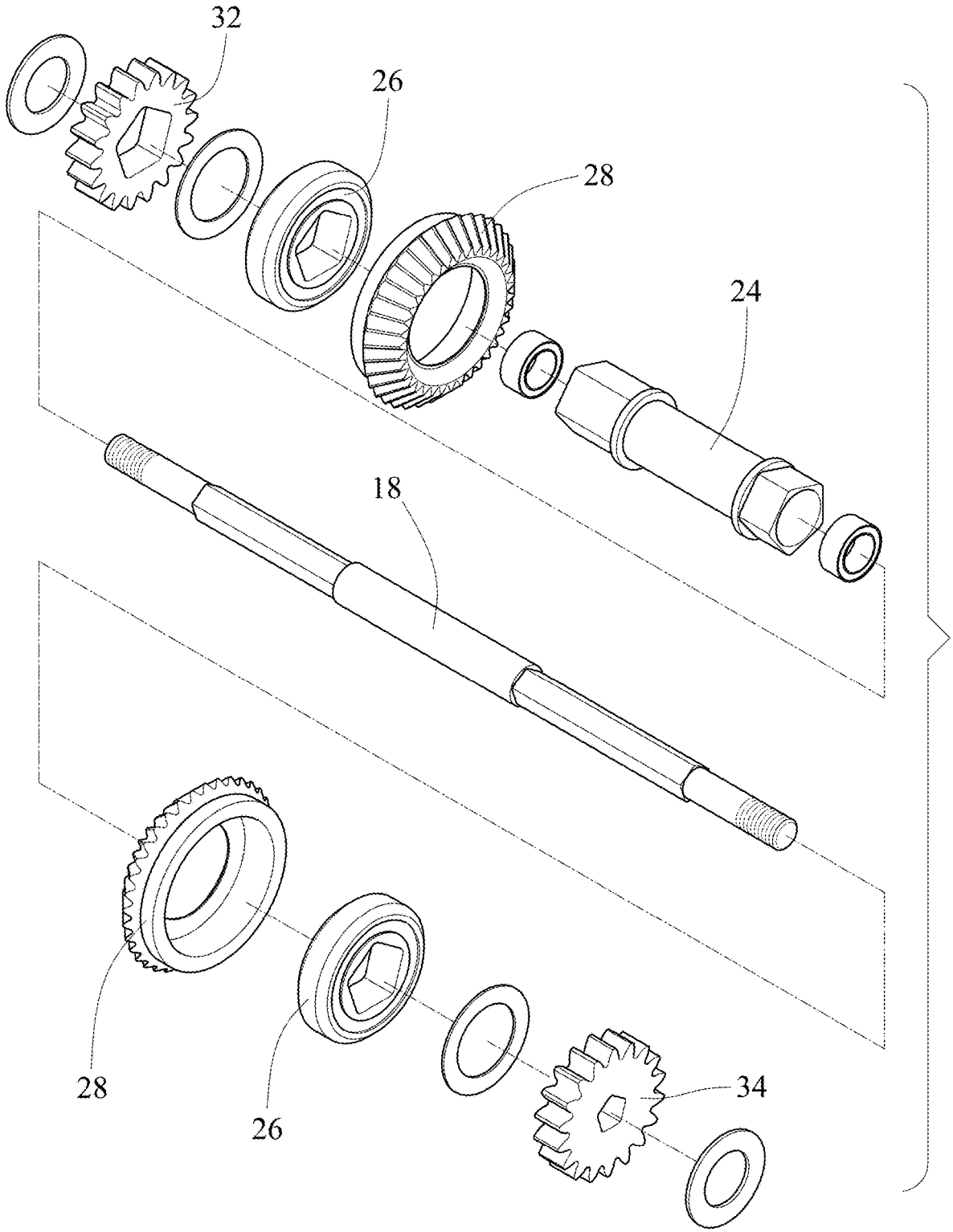
FIG. 6 is a partial view of the rolling unit shown in FIG. 3.
Figure 7:
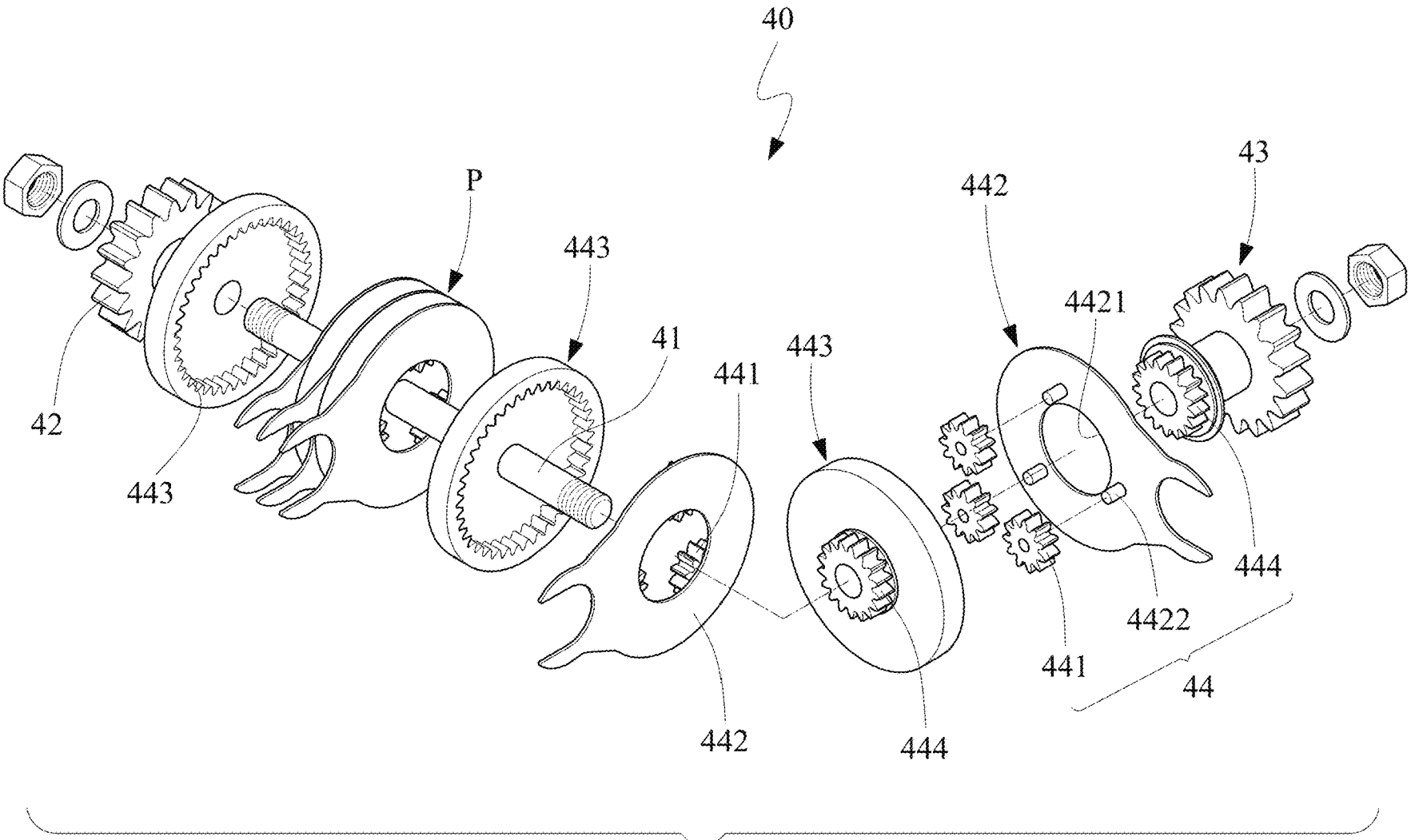
FIG. 7 is another partial view of the rolling unit shown in FIG. 3.
Figure 8:
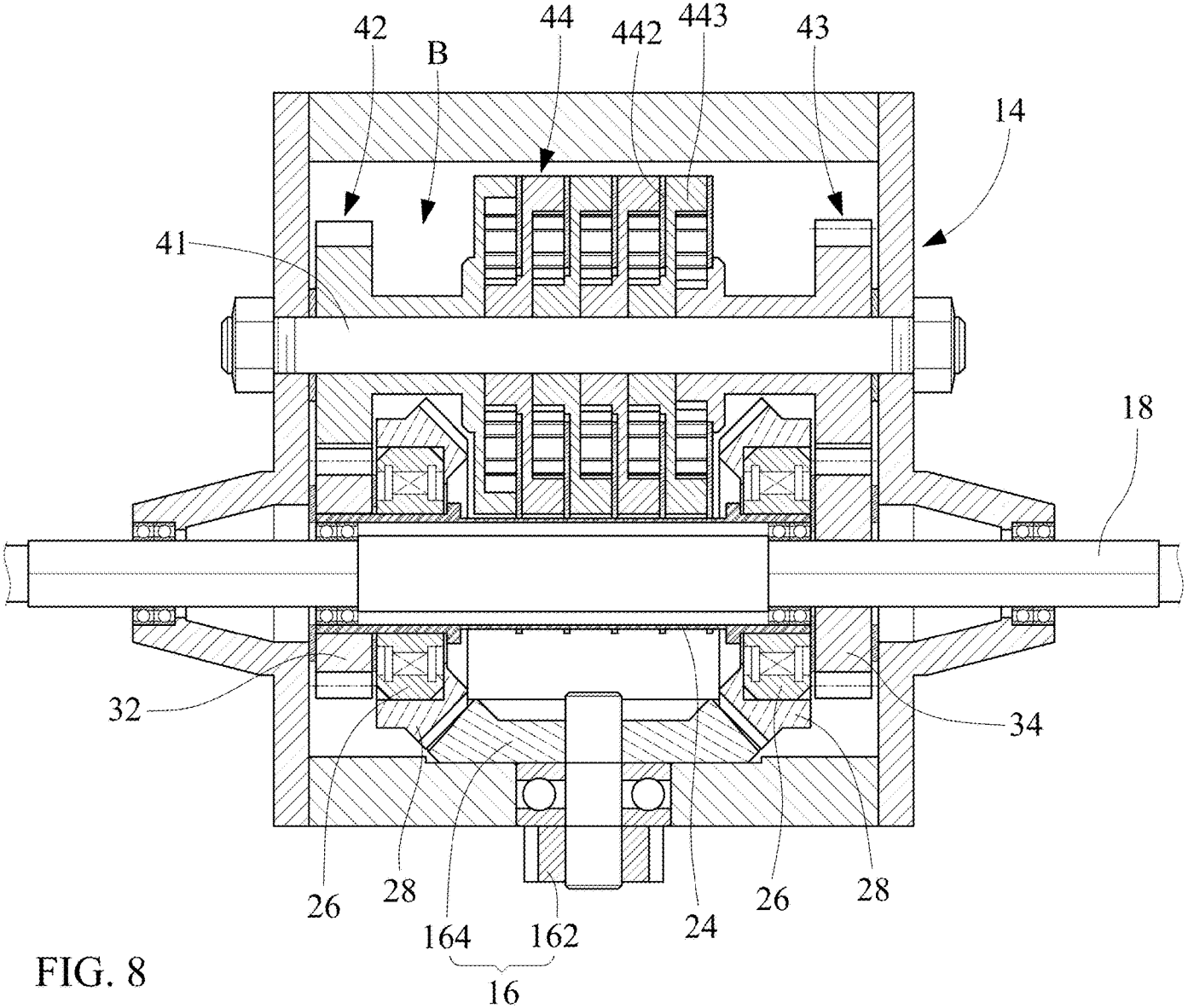
FIG. 8 is a partial and cross-sectional view of the rolling unit shown in FIG. 3.
Figure 9:
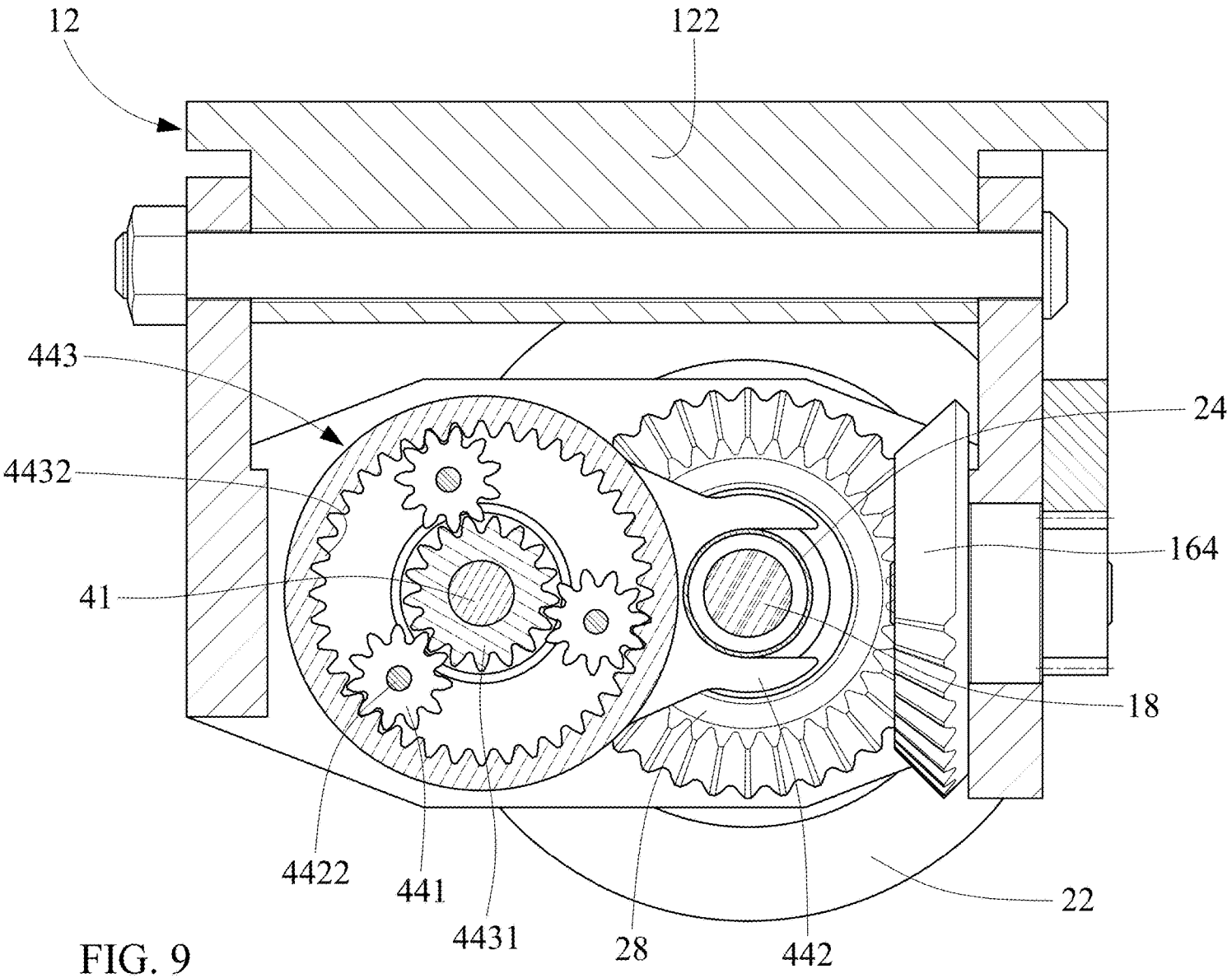
FIG. 9 is a cross-sectional view of the rolling unit shown in FIG. 3.

Referring to FIGS. 1 through 9, a skateboard includes a deck S and a rolling unit according to the preferred embodiment of the present invention. It should however be borne in mind that two such rolling units are used for the skateboard in practice. The rolling unit includes a truck 12, a box 14, a transmission 16, an axle 18, two wheels 22, a hollow shaft 24, two unidirectional bearings 26, two bevel gears 28, an input gear 32, an output gear 34 and an acceleration mechanism 40.

The truck 12 includes a tab 124 perpendicularly extending from a plate 122. The plate 122 is attached to a lower face of the deck S. The tab 124 includes an end connected to the plate 122 and another end formed with a rack 1242.

The box 14 is pivotally connected to the plate 122. The box 14 provides a space B.

The transmission 16 includes a pinion 162 and a bevel gear 164 connected to a common shaft (not numbered) borne on the box 14. The pinion 162 is engaged with the rack 1242. The bevel gear 164 is rotatable together with the pinion 162. The bevel gear 164 is located in the space B of the box 14.

The axle 18 is supported on the box 14. The axle 18 includes two ends located out of the box 14.

Each of the wheels 22 is connected to a corresponding one of the ends of the axle 18.

The hollow shaft 24 wraps the axle 18 and they are relative to each other through 40.

The unidirectional bearings 26 are connected to an external face of the hollow shaft 24.

Each of the bevel gears 28 is connected to the hollow shaft 24 via a corresponding one of the unidirectional bearings 26 so that they bevel gears 28 are rotatable relative to the hollow shaft 24 in a single direction. The bevel gears 28 are engaged with the bevel gear 164.

The input gear 32 is connected to the hollow shaft 24 so that they are rotatable with each other.

The output gear 34 is connected to the axle 18 so that they are rotatable with each other.

The acceleration mechanism 40 is located in the space B of the box 14. The acceleration mechanism 40 includes an end connected to the input gear 32 and another end connected to the output gear 34. The acceleration mechanism 40 includes a shaft 41, an input gear 42, an output gear 43, and five epicyclic gearings 44 for example.

The shaft 41 is located in the space B of the box 14. The shaft 41 includes two ends rotationally connected to the box 14.

The input gear 42 extends around the shaft 41 so that they are concatenated to each other.

The output gear 43 extends around the shaft 41 so that they are concatenated to each other.

The epicyclic gearings 44 are arranged between the input gear 42 and the output gear 43.

Each of the epicyclic gearings 44 includes three planet gears 441 for example, a planet carrier 442, a ring gear 443 and a sun gear 444. The planet carrier 442 includes a yoke (not numbered) for contact with the hollow shaft 24 so that the former is not pivotable relative to the latter. The planet carrier 442 further includes three pivots 4422 arranged around an aperture 4421 cut in a center. The shaft 41 extends through the aperture 4421. Each of the planet gears 441 is rotationally supported on a corresponding one of the pivots 4422. The ring gear 443 is engaged with the planet gears 441. The sun gear 444 is engaged with the planet gears 441.

The input gear 42 is connected to the ring gear 443 of the first epicyclic gearing 44 so that they are rotatable with each other. The sun gear 444 of the first epicyclic gearing 44 is connected to the ring gear 443 of the second epicyclic gearing 44 so that they are rotatable with each other. The sun gear 444 of the second epicyclic gearing 44 is connected to the ring gear 443 of the third epicyclic gearing 44 so that they are rotatable with each other. The sun gear 444 of the third epicyclic gearing 44 is connected to the ring gear 443 of the fourth epicyclic gearing 44 so that they are rotatable with each other. The sun gear 444 of the fourth epicyclic gearing 44 is connected to the ring gear 443 of the fifth epicyclic gearing 44 so that they are rotatable with each other. The sun gear 444 of the fifth epicyclic gearing 44 is connected to the output gear 43. There is gap P between the planet carriers 442 of any two adjacent ones of the epicyclic gearings 44.

Figure 10:
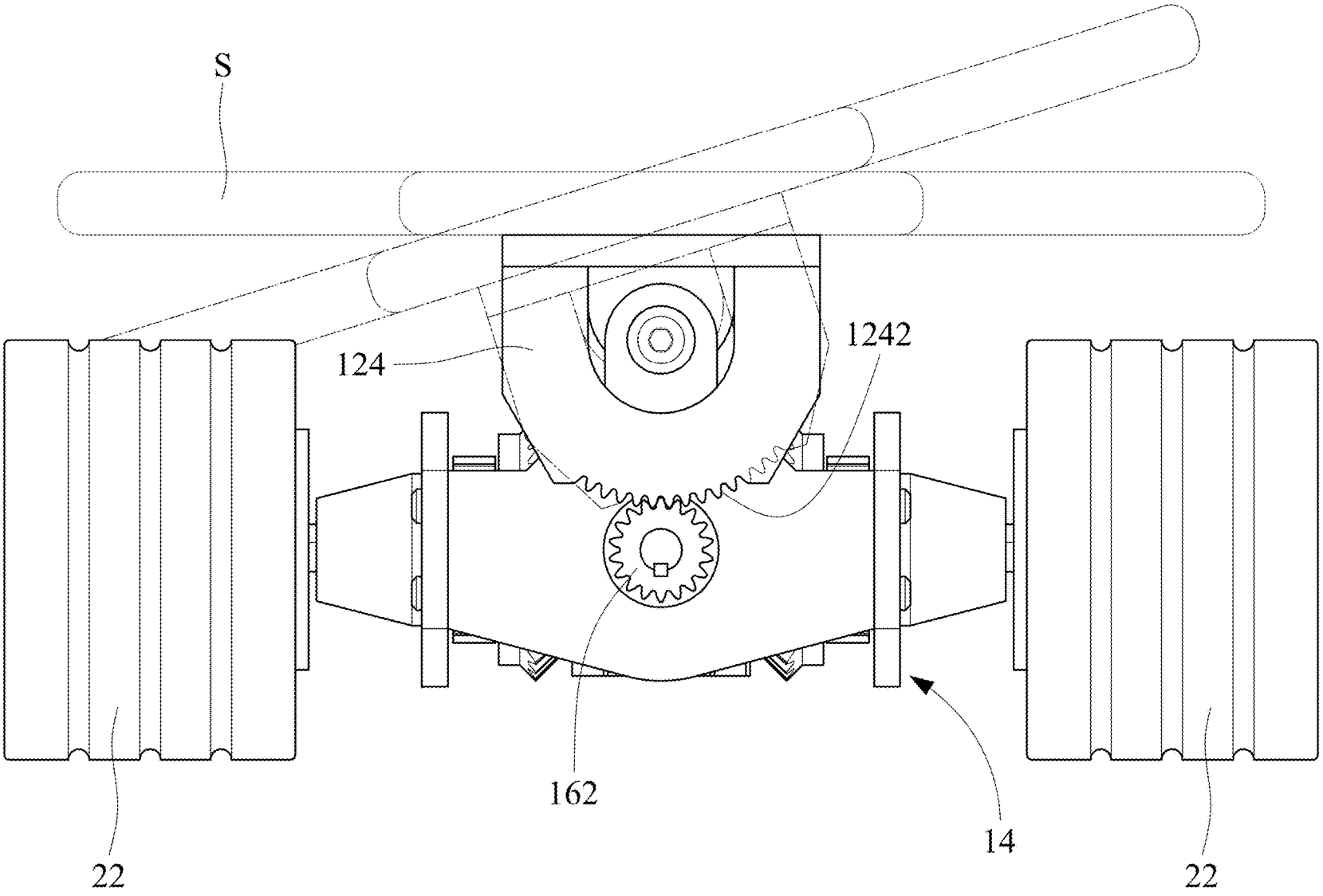
FIG. 10 is a front view of the skateboard shown in FIG. 1.

Referring to FIGS. 1 through 10, a user stands on the deck S with two legs. The user leans and rises and twists on the deck S. Thus, the user tilts the deck S forth and back and hence pivots the truck 12 to and forth, thereby moving the rack 1242 to and forth.

The rack 1242 moves to and forth to rotate the pinion 162 since they are engaged with each other. The pinion 162 rotates the bevel gear 164.

The bevel gear 164 rotates the hollow shaft 24 via the first bevel gear 28 without rotating the second bevel gear 28. Then, the bevel gear 164 rotates the hollow shaft 24 via the second bevel gear 28 without rotating the first bevel gear 28. The bevel gear 164 is allowed to rotate the hollow shaft 24 alternately via the bevel gears 28 because the bevel gears 28 are supported on the hollow shaft 24 via the unidirectional bearings 26.

The hollow shaft 24 rotates the input gear 32. The input gear 32 rotates the input gear 42. The put gear 32 rotates the input gear 42. The input gear 42 rotates the output gear 43 through the epicyclic gearings 44. The output gear 43 rotates the output gear 34. The output gear 34 rotates the axle 18. The axle 18 rotates the wheels 22.

Advantageously, the acceleration mechanism 40, which includes the epicyclic gearings 44, turns mild movement of the user into considerable movement of the skateboard. Hence, the user easily propels the skateboard.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A skateboard comprising a deck(S) and a rolling unit comprising:

a truck (12) comprising a plate (122) connected to a lower face of the deck(S) and a tab (124) extending from the plate (122) and comprising a rack (1242);

a box (14) pivotally connected to the plate (122);

a transmission (16) comprising a pinion (162) and a driving bevel gear (164) connected to the pinion (162) so that they are rotatable with each other, wherein the pinion (162) is located out of the box (14) and engaged with the rack (1242), wherein the driving bevel gear (164) is located in the box (14);

an axle (18) comprising a middle section extending in the box (14) and two ends extending from the box (14);

two wheels (22) respectively connected to the ends of the axle (18);

a hollow shaft (24) wrapping the axle (18);

two driven bevel gears (28) engaged with the driving bevel gear (164);

two unidirectional bearings (26) respectively supporting the driven bevel gears (28) on the hollow shaft (24);

a primary input gear (32) connected to the hollow shaft (24) so that they are rotatable with each other;

a primary output gear (34) connected to the axle (18) so that they are rotatable with each other; and an acceleration mechanism (40) arranged between the primary input and output gears (32, 34).

2. The skateboard according to claim 1, wherein the acceleration mechanism (40) comprises:

a shaft (41) located in and rotationally connected to the box (14);

a secondary input gear (42) rotationally supported on a section of the shaft (41) and engaged with the primary input gear (32);

a secondary output gear (43) rotationally supported on another section of the shaft (41) and engaged with the primary output gear (34);

an epicyclic gearing (44) comprising a ring gear (443) connected to the secondary input gear (42) so that they are rotatable with each other, a planet carrier (442) not rotatable relative to the hollow shaft (24), multiple planet gears (441) supported on the plate carrier (442), and a sun gear (444) engaged with the planet gears (441), wherein the sun gear (444) is connected to the secondary output gear (43) so that they are rotatable with each other.

3. The skateboard according to claim 2, wherein the acceleration mechanism (40) comprises multiple epicyclic gearings (44), wherein the ring gear (443) of a first one of the epicyclic gearings (44) is connected to the secondary input gear (42), wherein the sun gear (444) of a last one of the epicyclic gearings (44) is connected to the secondary output gear (43), wherein the sun gear (444) of each of the epicyclic gearings (44) is connected to the ring gear (443) of a next one of the epicyclic gearings (44).

* * * * *